US011268297B2

(12) United States Patent
Nottebaum

(10) Patent No.: US 11,268,297 B2
(45) Date of Patent: Mar. 8, 2022

(54) SECURING DEVICE FOR FRONT HOODS, COMPRISING AN ELECTRIC DRIVE

(71) Applicant: Kiekert AG, Heiligenhaus (DE)

(72) Inventor: Thorsten Nottebaum, Mühltal (DE)

(73) Assignee: Kiekert AG, Heiligenhaus (DE)

( * ) Notice: Subject to any disclaimer, the term of this patent is extended or adjusted under 35 U.S.C. 154(b) by 622 days.

(21) Appl. No.: 15/742,906

(22) PCT Filed: Jul. 1, 2016

(86) PCT No.: PCT/DE2016/100295
§ 371 (c)(1),
(2) Date: Jan. 9, 2018

(87) PCT Pub. No.: WO2017/005246
PCT Pub. Date: Jan. 12, 2017

(65) Prior Publication Data

US 2018/0216366 A1 Aug. 2, 2018

(30) Foreign Application Priority Data

Jul. 9, 2015 (DE) ..... 10 2015 111 149.7

(51) Int. Cl.
*E05B 15/02* (2006.01)
*E05B 63/24* (2006.01)
(Continued)

(52) U.S. Cl.
CPC ..... *E05B 15/022* (2013.01); *E05B 63/244* (2013.01); *E05B 83/24* (2013.01);
(Continued)

(58) Field of Classification Search
CPC ..... E05B 15/022; E05B 63/244; E05B 83/24; E05B 85/045; E05B 2047/0021;
(Continued)

(56) References Cited

U.S. PATENT DOCUMENTS 2,285,682 A * 6/1942 Rhodes ..... E05B 83/247 292/214
2,333,466 A * 11/1943 Claud-Mantle ..... E05B 83/24 292/11
(Continued)

FOREIGN PATENT DOCUMENTS

DE 4239908 C1 3/1994
DE 296 00 386 U1 5/1997
(Continued)

OTHER PUBLICATIONS

International Search Report and Written Opinion for corresponding Patent Application No. PCT/DE2016/100295 dated Oct. 31, 2016.

*Primary Examiner* — Christine M Mills
*Assistant Examiner* — Faria F Ahmad
(74) *Attorney, Agent, or Firm* — Renner, Otto, Boisselle & Sklar, LLP

(57) ABSTRACT

The invention relates to a securing device (1; 101) for a motor vehicle, having a front hood (2, 102) and a hood lock (3, 103) with a lock holder (10, 110). The hood lock (3, 103) has a rotary latch (4, 104) with a pre-locking position and a main locking position and an electric drive (5, 105) which causes a switchover of the rotary latch (4, 104) from the main locking position into the pre-locking position. In the main locking position, a release of the lock holder (10, 110) is blocked, and the front hood (2, 102) is closed. In the pre-locking position, the lock holder (10, 110) can be manually moved between a closed position, in which the lock holder (10, 110) is engaged with the rotary latch (4, 104) and the front hood (2, 102) is locked, and an open position, in which the lock holder (10, 110) is released from the rotary latch (4, 104) and the front hood (2, 102) is unlocked.

17 Claims, 6 Drawing Sheets

Figure 1:
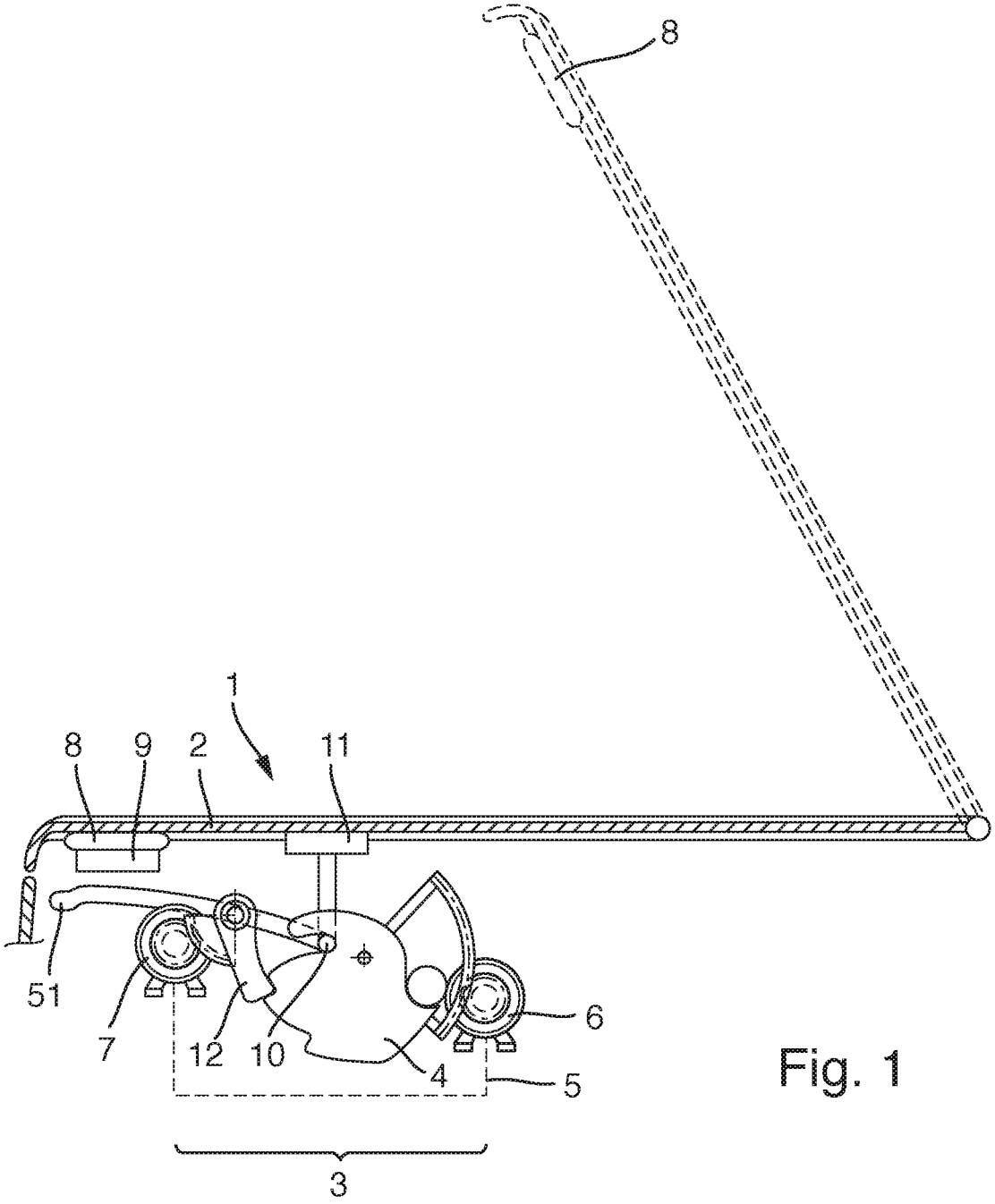

(51) Int. Cl.

| | |
|---|---|
| ***E05B 83/24*** | (2014.01) |
| ***E05B 85/04*** | (2014.01) |
| ***E05C 3/24*** | (2006.01) |
| ***E05B 47/00*** | (2006.01) |
| ***E05B 81/06*** | (2014.01) |
| ***E05B 81/14*** | (2014.01) |
| ***E05B 81/20*** | (2014.01) |
| ***E05B 77/08*** | (2014.01) |
| ***E05B 17/00*** | (2006.01) |

(52) U.S. Cl.
CPC ..... *E05B 85/045* (2013.01); *E05C 3/24* (2013.01); *E05B 17/0037* (2013.01); *E05B 77/08* (2013.01); *E05B 81/06* (2013.01); *E05B 81/14* (2013.01); *E05B 81/20* (2013.01); *E05B 2047/0021* (2013.01); *Y10S 292/14* (2013.01); *Y10T 292/108* (2015.04); *Y10T 292/1047* (2015.04); *Y10T 292/1079* (2015.04); *Y10T 292/1082* (2015.04); *Y10T 292/1092* (2015.04)

(58) Field of Classification Search
CPC ..... E05B 81/06; E05B 81/14; E05B 81/20; E05B 17/0037; E05B 63/24; E05B 77/08; E05C 3/24; Y10S 292/14; Y10T 292/1079; Y10T 292/108; Y10T 292/1082; Y10T 292/1092; Y10T 292/1047; B60R 21/38
USPC ..... 296/187.04, 193.11
See application file for complete search history.

(56) References Cited

U.S. PATENT DOCUMENTS 2,658,779 A * 11/1953 Dall ..... E05B 83/24 292/66
2,693,977 A * 11/1954 Sigel ..... E05B 83/24 292/221
2,729,487 A * 1/1956 Krause ..... E05B 83/24 292/99
2,743,601 A * 5/1956 Dlugatch ..... E05B 83/24 70/240
2,773,715 A * 12/1956 Lindner ..... E05C 19/007 292/252
2,781,214 A * 2/1957 Claud-Mantle ..... E05B 83/24 292/11
2,809,064 A * 10/1957 Dlugatch ..... E05B 83/24 292/226
2,815,822 A * 12/1957 Paul ..... E05B 83/24 180/69.21
2,829,914 A * 4/1958 Peras ..... E05B 83/16 292/217
2,834,626 A * 5/1958 Claud-Mantle ..... E05B 83/24 292/52
2,852,293 A * 9/1958 Claud-Mantle ..... E05B 83/24 292/54
2,859,062 A * 11/1958 Hynes ..... E05B 83/24 292/11
2,864,635 A * 12/1958 Lindner ..... E05C 19/007 292/12
2,877,035 A * 3/1959 Claud-Mantle ..... E05C 19/008 292/56
2,884,275 A * 4/1959 Claud-Mantle ..... E05B 83/24 292/52
2,955,859 A * 10/1960 Krause ..... E05B 83/24 292/6
2,996,324 A * 8/1961 Krause ..... E05B 83/24 292/226
3,003,800 A * 10/1961 Hammond ..... E05B 83/24 292/11
3,012,805 A * 12/1961 Poe ..... E05B 83/24 292/229
3,039,801 A * 6/1962 Dacey ..... E05B 83/24 292/11
3,088,765 A * 5/1963 Krause ..... E05B 83/24 292/11
3,188,126 A * 6/1965 Krause ..... E05B 83/16 292/11
3,347,071 A * 10/1967 Solow ..... E05B 83/24 70/240
3,392,557 A * 7/1968 Solow ..... E05B 83/24 70/240
3,397,906 A * 8/1968 Beckman ..... E05B 83/16 292/29
3,463,529 A * 8/1969 Rubbio ..... E05B 79/20 292/106
3,893,207 A * 7/1975 Rudaitis ..... E05B 83/24 180/69.21
3,924,884 A * 12/1975 Christie ..... E05C 3/16 292/196
3,966,244 A * 6/1976 Kleisser ..... E05B 83/24 292/127
4,057,271 A * 11/1977 Colinet ..... E05B 83/24 292/87
4,756,562 A * 7/1988 Foster ..... E05B 83/24 292/28
4,872,366 A * 10/1989 Appleby ..... E05B 83/24 74/501.6
4,961,601 A * 10/1990 Lindholm ..... E05B 83/16 292/216
4,968,073 A * 11/1990 Kuhlman ..... E05B 81/22 292/201
4,991,884 A * 2/1991 Cairns ..... E05B 83/24 292/28
5,000,493 A * 3/1991 Bastien ..... E05B 83/24 292/11
5,046,768 A * 9/1991 Myslicki ..... E05B 83/24 292/68
5,048,877 A * 9/1991 Rogers, Jr. ..... E05C 5/00 292/110
5,141,265 A * 8/1992 Claar ..... E05B 83/24 292/100
5,853,060 A * 12/1998 Chao ..... E05B 83/16 180/69.2
6,056,334 A * 5/2000 Petzold ..... E05B 81/14 292/201
6,109,670 A * 8/2000 Tomaszewski ..... E05B 83/24 292/216
6,279,361 B1 * 8/2001 Baukholt ..... E05B 81/14 292/201
6,422,616 B1 * 7/2002 Wortmann ..... E05B 83/24 292/214
6,474,704 B1 * 11/2002 Rathmann ..... E05B 81/14 292/201
6,543,822 B1 * 4/2003 King ..... E05B 83/24 292/214
6,616,199 B1 * 9/2003 Tokach ..... E02F 9/0866 292/11
7,627,986 B2 * 12/2009 Hirai ..... E05B 81/22 49/280
8,608,221 B1 * 12/2013 Krajenke ..... E05B 79/20 296/76
9,145,716 B2 * 9/2015 Jayasuriya ..... E05B 83/24
9,458,647 B2 * 10/2016 Gartner ..... E05B 17/2092
2001/0007396 A1 * 7/2001 Mizuta ..... B62D 33/0625 296/193.11
2001/0027146 A1 * 10/2001 Spaziani ..... F16H 37/065 477/3
2002/0000725 A1 * 1/2002 Ostrowski ..... E05B 81/20 292/199
2002/0050414 A1 * 5/2002 Brogly ..... E05B 77/08 180/69.2
2003/0122382 A1 * 7/2003 Baniak ..... E05B 83/24 292/116
2005/0046199 A1 * 3/2005 Dzurko ..... E05B 85/243 292/199
2005/0093685 A1 * 5/2005 Kachouh ..... B60N 2/0244 340/438

(56) References Cited

U.S. PATENT DOCUMENTS

2006/0032693 A1* 2/2006 Parks ..... E05B 77/08 180/271
2006/0082165 A1* 4/2006 Rose ..... B60R 25/04 292/337
2007/0246944 A1* 10/2007 Sundararajan ..... E05B 77/08 292/92
2007/0246952 A1* 10/2007 Beauchamp ..... E05B 83/24 292/216
2008/0164703 A1* 7/2008 Aubry ..... E05B 81/20 292/201
2009/0295174 A1* 12/2009 Corrales ..... E05B 81/14 292/169.14
2010/0244484 A1* 9/2010 Nakaura ..... B60R 21/38 296/187.04
2012/0043766 A1* 2/2012 Nurmi ..... E05B 83/24 292/126
2012/0049543 A1* 3/2012 Park ..... E05B 83/24 292/220
2012/0074715 A1* 3/2012 Kim ..... B60R 21/34 292/201
2013/0300134 A1* 11/2013 Jayasuriya ..... E05B 83/24 292/129
2014/0054903 A1* 2/2014 Kim ..... E05B 83/24 292/96
2015/0115625 A1* 4/2015 Park ..... E05B 83/24 292/194
2016/0186468 A1* 6/2016 Ilea ..... E05B 83/18 292/201
2017/0101810 A1* 4/2017 Lee ..... E05B 79/16
2018/0230718 A1* 8/2018 Menke ..... E05B 15/022
2018/0252007 A1* 9/2018 Krause ..... E05B 85/045
2018/0266150 A1* 9/2018 Nottebaum ..... E05B 81/16
2019/0232915 A1* 8/2019 Szente ..... E05B 77/08
2020/0141164 A1* 5/2020 Kim ..... B60R 21/0134

FOREIGN PATENT DOCUMENTS

DE 198 12 835 A1 9/1999
DE 10004242 A1 8/2000
DE 10 2005 044 079 A1 3/2007
DE 10 2007 061 544 A1 6/2009
DE 10 2010 061518 A1 4/2012
DE 102010056413 A1 6/2012
DE 10 2013 003956 A1 9/2014
WO 2007/031267 A1 3/2007
WO 2013/087454 A1 6/2013

* cited by examiner

SECURING DEVICE FOR FRONT HOODS, COMPRISING AN ELECTRIC DRIVE

The invention relates to a safety device for a motor vehicle, having a front hood and a hood latch with a latch holder.

Such a safety device is known from DE 198 12 835 A1. The safety device described therein has an arrester hook operating arrangement which is accomplished by means of a lever construction and in which no rotational construction elements occur. This safety device is thus characterized by a very simple construction. The front hood is opened from the interior of the vehicle. An opening mechanism is usually achieved with the aid of a Bowden cable to open the interior of the vehicle. In DE 10 2007 061 544 A1 thus, for example, an operating lever is described for unlocking a motor hood which is arranged in the passenger space and is mechanically connected to a hood latch by means of a Bowden cable. Furthermore, DE 10 2005 044 079 A1 reveals unlocking of a hood latch by means of a Bowden cable.

Use of a Bowden cable has the disadvantage that, starting from the interior of the vehicle to the front area of the front hood, it needs to be conducted around several components in the engine compartment which requires space in the engine compartment and thus less space is available for arrangement of these components in the engine compartment. Thus, according to the state of the art, the safety device restricts possibilities of arrangement of other components in the engine compartment and is therefore impractical due to aspects concerned with manufacture and construction. Use of the Bowden cable to open the front hood is also impractical for an operator as he needs to search for an end of the Bowden cable which is usually located below a dashboard and can only move the Bowden cable with considerable force. However, use of the Bowden cable facilitates compliance with the required safety standards for front hoods which are generally higher compared to those for tailgates.

The task of the present invention is therefore to create a safety device of the type stated at the start which is more practical with a Bowden cable conducted through the engine compartment compared to a previously known safety device.

According to the invention, this task is solved by a safety device with the characteristics of the patent claim. Advantageous designs with expedient further formations of the invention result from the remaining patent claims, the description and the figures.

In order to create a safety device which is more practical compared with a previously known safety device, a safety device is provided for a motor vehicle having a front hood and a hood latch, whereby the hood latch has a catch with a pre-ratchet position and a main ratchet position and an electrical drive. The electrical drive causes switching of the catch from the main ratchet position into the pre-ratchet position, whereby the front hood is locked and closed in the main ratchet position. In the pre-ratchet position of the catch the latch holder can be manually moved between a closure position in which the latch holder is engaged with the catch and the front hood is bolted and an opening position in which the latch holder is released by the catch and the front hood is unbolted.

The electrical drive can preferably be controlled, switched on and/or switched off by means of a switch and/or a control device which is connected to the electrical drive by means of at least one cable and preferably controllable rotating into a first direction and optionally into a second direction opposite to the first. In particular, a rotational movement of the electrical drive causes a switching of the catch from the main ratchet position into the pre-ratchet position. As the electrical drive is connected to the switch and/or control device by means of a cable, a Bowden cable conducted through the engine compartment can be dispensed with to unbolt the front hood, facilitating an arrangement of other components in the engine compartment. A switch which operates the electrical drive can also be arranged at any point on a dashboard of a motor vehicle, so that the safety device is easier to unbolt for an operator and is thus more practical.

In the main ratchet position the catch is locked in an opening rotational direction which is specified by a rotation of the catch from the main ratchet position into the pre-ratchet position and encompasses the latch holder in such a way that a release of the latch holder is blocked. In particular, the latch holder is manually immovable if the catch is located in the main ratchet position; in particular, it cannot be detached purely mechanically with a handle. The catch has an infeed section which is formed by a load arm and a collecting arm, whereby the infeed section encompasses the latch holder in the main ratchet position. The latch holder can be executed as bolt, pin or locking bracket and the infeed section in a fork-shaped manner. In particular, the latch holder is blocked in the main ratchet position by means of the load arm. The latch holder can generally be viewed as a connecting element between the catch and the front hood which interacts directly with the catch and can be bolted and unbolted with the aid of the catch, whereby bolting or unbolting of the latch holder causes bolting or unbolting of the front hood.

In an advantageous design, the latch holder is arranged on the front hood and the catch is arranged on a component of a motor vehicle fixed to the chassis. In a different design therefrom, the latch holder can also be arranged on a component of the motor vehicle fixed to the chassis and the catch to the front hood. The thus greater mass inertia of the front hood can reduce a rebound effect of the front hood during closure of the front hood which preferably counteracts in the pre-ratchet position of the load arm of the catch.

In particular, by means of the electrical drive of the hood latch an arrangement of the catch is considerably facilitated on the front hood as only a cable instead of a Bowden cable must be conducted along the movable front hood in this embodiment. An arrangement of the catch on the front hood can be advantageous from a manufacturing perspective to the extent that the catch and the electrical drive can be better mounted on a single front hood than in an already equipped engine compartment.

The hood latch preferably has a catch blocking element, such as a pawl, which blocks the catch in the main ratchet position and/or in the pre-ratchet position, whereby blocking means a blocking of the catch in the opening rotational direction. Furthermore, it is within the scope of the invention that the catch has a pre-ratchet contour and a main ratchet contour which can respectively interact independently with a counterratchet contour of the catch blocking element during rotation of the catch in the opening rotational direction and into a closure rotational direction which is opposite to the opening rotational direction. Especially advantageously, during rotation of the catch in the closure rotational direction the pre-ratchet contour or main ratchet contour passes the counterratchet contour of the pawl. If the pre-ratchet contour or main ratchet contour is located in front of the counterratchet contour of the pawl viewed from the closure rotational direction, the counterratchet contour ratchets, preferably in a spring-impinged manner into the pre-ratchet contour or the main ratchet contour and blocks a rotation of the catch in the opening rotational direction, whereby the catch assumes the pre-ratchet position or the main ratchet position. Advantageously a catch spring element acts on the catch in the opening rotational direction, whereby in the pre-ratchet position or the main ratchet position the pre-ratchet contour or the main ratchet contour is held pressed against the counterratchet contour accordingly. The catch spring element can be tensioned during a movement of the front hood in the direction of the closure position, whereby the latch holder comes into contact with the catch. A tensioned catch spring element can enable an independently driven switching catch from the main ratchet position into the pre-ratchet position, whereby such switching can be triggered by means of the electrical drive, for example by driving of the pawl.

A special design envisages that the catch is immovable beyond the pre-ratchet position without blocking by means of the pawl in the opening rotational direction, i.e. that the catch has an opening end position with the pre-ratchet position. In a different embodiment, the catch has an opening end position in which the catch is rotated from the pre-ratchet position in the opening rotational direction.

The front hood is closed in the main ratchet position of the catch. Closed means that the front hood, which can be moved in a first direction into an opening position and in a second direction opposite to the first direction to a closure position, is located in the closure position. In particular it is envisaged when the front hood is closed that an elastic element of the safety device is compressed, such as a sealing rubber which is adjacent to the front hood in the closure position or is arranged on the front hood. For the purpose of the invention, a front hood means a hood which is arranged in the motor vehicle direction in front of a windshield of a motor vehicle.

Starting from the main ratchet position of the catch, on its activation or control the electrical drive causes switching of the catch from the main ratchet position into the pre-ratchet position. The electrical drive can, for example, be activated from inside the vehicle or from outside the vehicle using a remote control. Preferably, during switching from the main ratchet position into the pre-ratchet position by means of the latch holder the catch moves the front hood in the direction of the open position of the front hood. Advantageously, in this movement of the front hood an engagement area is provided to grip a handle or the latch holder. In the pre-ratchet position, the catch is blocked in its opening rotational direction, preferably by means of the pawl and the latch holder is engaged with the catch insofar as it is located in the closure position.

By means of this engagement, the catch blocks a movement of the front hood in the direction of the open position which corresponds to a bolting of the front hood. In one embodiment, in which the latch holder is arranged on the front hood, the catch in the pre-ratchet position of the catch and in the closure position of the latch holder blocks a movement of the latch holder, at least into a blocking direction which corresponds to a movement of the front hood in the direction of the open position and is preferably crucially oriented vertically to a vehicle lengthwise axis.

According to the invention, the latch holder is moveable in the pre-ratchet position from the closure position to the opening position manually, i.e. for an operator of the safety device, whereby the latch holder is preferably held in a spring-impinged manner in the closure position. Manually movable means, for the purpose of the invention, in particular exclusively mechanically, i.e. without current and electrical aids. In particular, in the pre-ratchet position the latch holder is accessible for an operator from outside the safety device, for example via a handle of the safety device, such as an operating lever which is kinematically connected to the latch holder. In other words, the latch holder is mechanically detachable by an operator in the pre-ratchet position. Provision of manual access to the latch holder is especially advantageous during switching of the catch from the main ratchet position into the pre-ratchet position.

The latch holder can preferably be moved in the pre-ratchet position from the closure position to the opening position at least in a direction vertically to the blocking direction. A special embodiment envisages that the latch holder can be moved in the pre-ratchet position from the closure position to the opening position obliquely to the blocking direction. This can cause a more ergonomic operation of the latch holder as an operator of the safety device grasps obliquely downwards to the latch holder or the handle when disengaging the latch holder. In a special design, the catch remains static during movement of the latch holder from the closure position to the opening position.

In a different design, the catch follows by means of rotation at least partly of an adjustment of the latch holder from the closure position to the opening position. In this design, the catch can preferably be manually disengaged from the pre-ratchet position. In one design with especially high safety the front hood, starting from the pre-ratchet position of the catch, can be unbolted by means of at least dual manual operation, on the one hand by means of manual disengagement of the catch from the pre-ratchet position and on the other hand by means of manual movement of the latch holder from the closure position to the opening position.

A further design can envisage that the catch, assisted by the pre-tensioned catch spring element, rotates in the opening rotational direction in a spring-impinged manner by means of manual disengagement of the catch from the pre-ratchet position and the latch holder moves from the closure position into the opening position. In this case, the latch can be moved manually indirectly by means of disengagement of the catch.

In the opening position, the latch holder is released from the catch and blockage of a movement of the front hood is disengaged in the direction of the open position which corresponds to an unbolting of the front hood. The latch holder can preferably be accommodated or caught by means of the catching arm of the catch on shutting of the front hood.

Due to the fact that according to the invention the front hood is bolted in the closure position of the latch holder and the pre-ratchet position of the catch, starting from a closed state of the front hood dual operation of the safety device is envisaged to unbolt the front hood. On the one hand, activation of the electrical drive to switch the catch from the main ratchet position into the pre-ratchet position and, on the other hand, manual movement of the latch holder from the closure position to the opening position. This redundancy gives the safety device according to the invention greater safety compared to a safety device without additional manual operation of the latch holder or without operation of an electrical drive.

Switching of the catch from the main ratchet position to the pre-ratchet position is caused by means of the electrical drive which has a pinion shaft according to the invention. This can be executed in a special design by means of a triggering lever which is acted on by means of a pinion shaft of the electrical drive, whereby the triggering lever causes unratcheting of the catch from the main ratchet position in a movement of the pinion shaft. For example, the triggering lever can move the pawl against a spring force which acts on the pawl and move away the counterratchet contour from the main ratchet contour or release the same from the ratchet position. According to this, for the purpose of the invention, causing switching of the catch from the main ratchet position into the pre-ratchet position also triggers this switching.

Furthermore, it is possible that the triggering lever releases a pre-tensioned force spring in a movement of the pinion shaft which unratchets the pawl against its spring impingement. This variant has the advantage that the electrical drive can have smaller dimensions as only the pre-tensioned force spring needs to be disengaged by means of the drive. However, in this design an additional gearbox is necessary to tension the force spring by means of the electrical drive. Advantageously, the force spring can be tensioned during rotation of the catch in the closure rotational direction, preferably weight-assisted by a movement of the front hood in the direction of the closure position.

A further design can envisage that the pinion shaft of the electrical drive acts directly on the pawl and unratchets the counterratchet contour of the pawl from the main ratchet contour during activation of the electrical drive. An advantage of this design is that no transmission part is required between the pinion shaft and the pawl.

Within the scope of an especially preferred variant, the safety device has a mechanical operative connection between the electrical drive and the catch during switching of the catch from the main ratchet position into the pre-ratchet position. Advantageously, the safety device provides a force-transmitting operative connection chain in every intermediate position of the catch between the main ratchet position and the pre-ratchet position starting from the electrical drive via the catch to the latch holder.

For example, the mechanical operative connection can be formed by an output socket gear which is positively connected to the pinion shaft of the electrical drive and a pinion gear drive which is positively connected to the catch, whereby the output socket gear combs with the pinion gear drive. Impulsion of the catch with the aid of the electrical drive during switching from the main ratchet position into the pre-ratchet position enables a smaller dimensioning of the catch spring element, whereby space can be saved in direct proximity to the catch. A special design of the safety device can even envisage no catch spring element at all. The electrical drive can preferably be operated in generator mode in order to form mechanical resistance of the catch against a movement of the front hood in the direction of the closure position during trapping of the front hood.

In a further embodiment, the mechanical operative connection can be formed by a wormgear which is positively connected to the pinion shaft of the electrical drive and a wormgear wheel which is positively connected with the catch, whereby the wormgear grasps into the wormgear wheel. In any case, a mechanical operative connection means that a movement of the pinion shaft directly causes a movement of the catch, i.e. the pinion shaft is mechanically connected to the catch.

By means of the mechanical operative connection between the electrical drive and the catch it is possible and is within the scope of the invention that a movement of the front hood in the direction of the open position can be controlled during switching of the catch from the main ratchet position into the pre-ratchet position, i.e. that both initial acceleration of the front hood and also a braking acceleration can be controlled shortly before attainment of the pre-ratchet position of the catch, whereby the initial acceleration and the braking acceleration advantageously have a parabola-shaped course over time. For example, the braking acceleration on approximation of the catch to the pre-ratchet position can be reduced, whereby a nosing of the front hood can be minimized after the catch has reached the pre-ratchet position. The latch holder is therefore simpler to grasp and a more convenient opening of the front hood can be provided, especially if an operator is situated directly in front of the front hood and activates the electrical drive with the aid of a remote control.

A further design of the invention envisages that the safety device has a mechanical operative connection between the electrical drive and the catch during switching of the catch from the pre-ratchet position into the main ratchet position. The mechanical operative connection can be formed as described above, i.e. for example by means of an output socket gear and a pinion gear drive or by means of a wormgear and a wormgear wheel.

The mechanical operative connection between the electrical drive and the catch during switching of the catch from the pre-ratchet position into the main ratchet position causes a more powerful and in particular controllable ratcheting of the catch into the main ratchet position compared to the state of the art. A more powerful and in particular a controllable ratcheting of the catch enables execution of a smaller gap dimension between the front hood in the closed state and a further chassis component adjacent to the front hood. Advantageously, force transmission is envisaged from the electrical drive onto the catch which increases with approximation of the catch to the main ratchet position. Thus, the elastic element which is adjacent to the front hood when the front hood is closed can be compressed controlled by the electrical drive.

Especially advantageously, the catch can be held in a position in which the main ratchet contour is directly located in front of the counterratchet contour of the pawl during a ratcheting process in the closure rotational direction by means of the mechanical operative connection between the electrical drive and the catch during switching of the catch from the pre-ratchet position into the main ratchet position. Holding of the catch in this position, for example for 10 to 100 milliseconds, enables the ratcheting process of the counterratchet contour into the main ratchet contour to be delayed at will. On the contrary, for the safety devices according to the state of the art, a pawl spring which moves the counterratchet contour via the pawl into the main ratchet contour must be configured in such a way that it moves the pawl so quickly that the counterratchet contour ratchets into the main ratchet contour within the possible ratcheting period within a possible ratcheting period which starts with a rotation of the catch in the closure rotational direction with passing of the main ratchet contour on the counterratchet contour and ends with a passing of the main ratchet contour on the counterratchet contour with a rotation of the catch in the opening rotational direction. This requires relevant spring force which must be all the greater the shorter the ratcheting period. According to the state of the art, one possibility of extending the ratcheting period is that a gap size is increased between the front hood in the closed state and a further chassis part, for example a front headlight as the distance covered by the main ratchet contour within the ratcheting period is thus increased. Manual holding of the front hood would be almost impossible with a small gap size in a position in which the main ratchet contour is located directly in front of the counterratchet contour of the pawl during a ratcheting process in the closure rotational direction and the elastic element is compressed.

By means of the mechanical operative connection between the electrical drive and the catch during switching of the catch from the pre-ratchet position into the main ratchet position the duration of the ratcheting period can be increased at will as the catch can be held in any position for any duration by means of the electrical drive. A smaller dimensioning of the pawl spring is thus possible which saves weight and material costs. The gap size between the front hood and the other chassis part can also be considerably reduced as the ratcheting period no longer depends on the gap size. Such a safety device is therefore more practical from a manufacturing and structural perspective than one according to the state of the art.

A gap size between the closed front hood and at least a further chassis element, for example a front headlight, can be changed especially advantageously by means of the controlled compressible sealing element, whereby it is possible to offset manufacturing tolerances which impact a gap size between the front hood and the further chassis element. This constitutes a manufacturing simplification. In detail, this can be achieved with a main ratchet contour of the catch which is adjustable along the opening or closure rotational direction. For example, the main ratchet contour can be arranged regardless of the main ratchet contour on a disk which can be locked in the opening rotational direction or in the closure rotational direction of the catch by means of ratchet elements. In detail, the ratchet elements can be locked in adjustable ratchet positions by means of a tightening, for example by means of a screw.

A further advantageous embodiment envisages that the latch holder is pivotably executed. For example, the latch holder can be pivotably arranged by means of a coupling element, for example a bolt on the front hood. Furthermore, the safety device can have a handle which enables pivoting of the latch holder from the closure position to the opening position in the pre-ratchet position of the catch.

Furthermore, it can be provided for that the latch holder can be shifted, preferably in the direction of a lengthwise extension of the front hood. A variant can be provided for that the latch holder is conducted along the front hood by means of a coupling element, such as a rail. The lengthwise extension is aligned especially advantageously parallel to a vehicle lengthwise axis. This has the advantage that the latch holder can be shifted parallel to the vehicle lengthwise axis into the opening position by pulling or pushing in a direction which makes operation of the safety device more convenient. A different design envisages that the latch holder can be shifted transversely to the motor vehicle lengthwise axis. This can have an advantageous impact on the safety device to the extent that in the case of a frontal impact of the vehicle the latch holder is more difficult to move from the closure position to the opening position by means of an impact of an injured party.

A further design envisages that the safety device has a handle which enables shifting of the latch holder from the closure position to the opening position in the pre-ratchet position.

Regardless of whether the latch holder is pivotable or shiftable, it can be provided for that during switching of the catch from the main ratchet position to the pre-ratchet position the handle is transferred to an accessible operating position. During switching, the catch can impel the handle or release a spring-impinged lever which transfers the handle into the accessible operating position. The handle is preferably connected directly to the latch holder in the pre-ratchet position. The latch holder is thus directly movable by means of the handle, i.e. in particular shiftable and/or pivotable. It is also conceivable that the latch holder executes a movement which comprises a pivoting and a shifting when shifted from the closure position to the opening position. It is also possible that the handle is indirectly connected to the latch holder in the pre-ratchet position, for example by means of a spring element. During pulling or pushing of the handle, the spring element can be tensible, whereby a spring force can be built up. This enables gentle pulling or pushing of the handle to move the latch holder which is preferably held in a spring-impinged manner in the closure position. Furthermore, a damping element can also be switched between the handle and the latch holder which advantageously dampens a force impact between the latch holder and the handle so that operation of the handle is more convenient and thus more practical.

In a special embodiment, the handle is kinematically separated from the latch holder in the main ratchet position, i.e. the latch holder cannot be moved via the handle.

Other advantages, characteristics and details of the invention result from the following description of at least a preferred execution example to which the invention is not limited however and on the basis of the figures.

Figure 2:
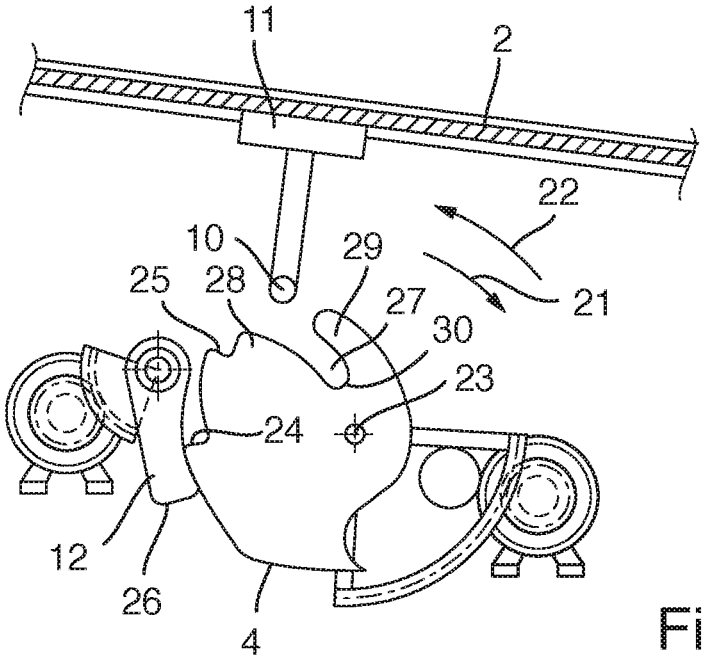
Figure 3:
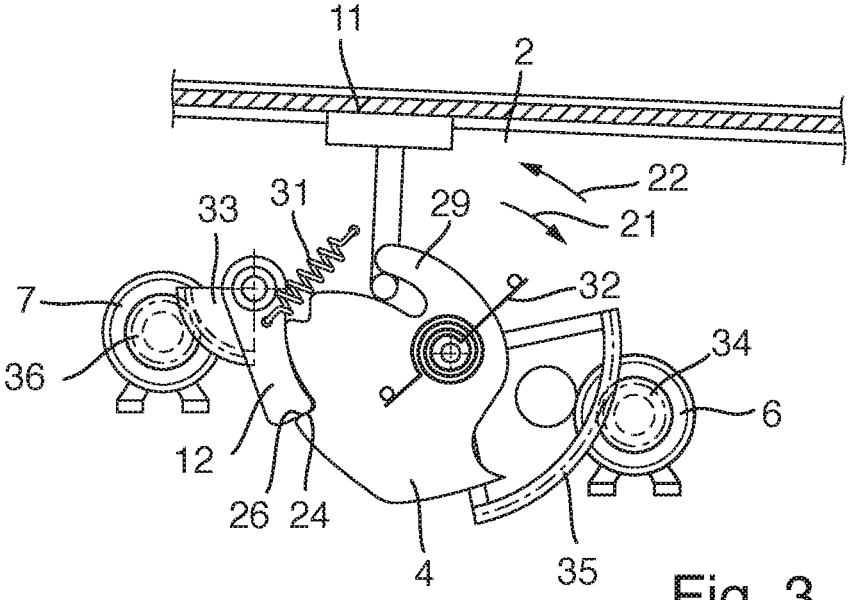
Figure 4:
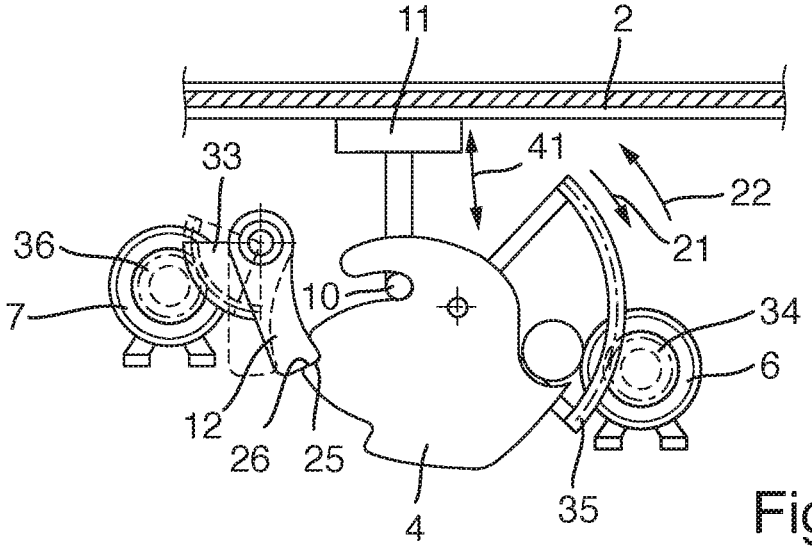
Figure 5:
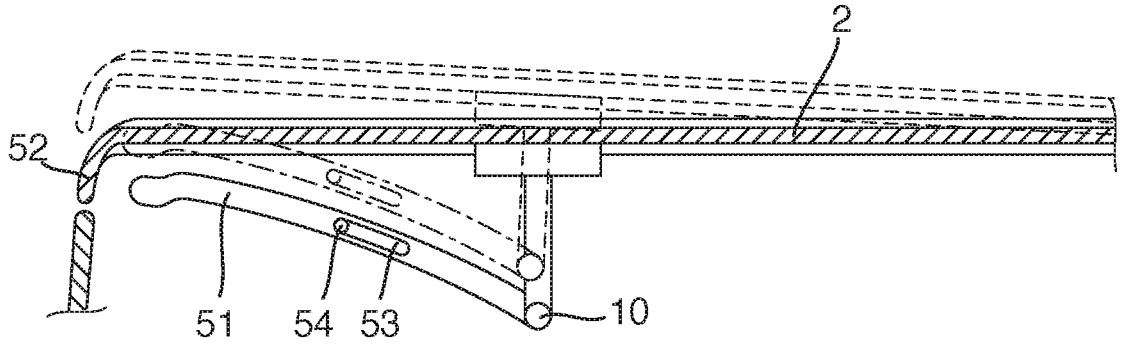
Figure 6:
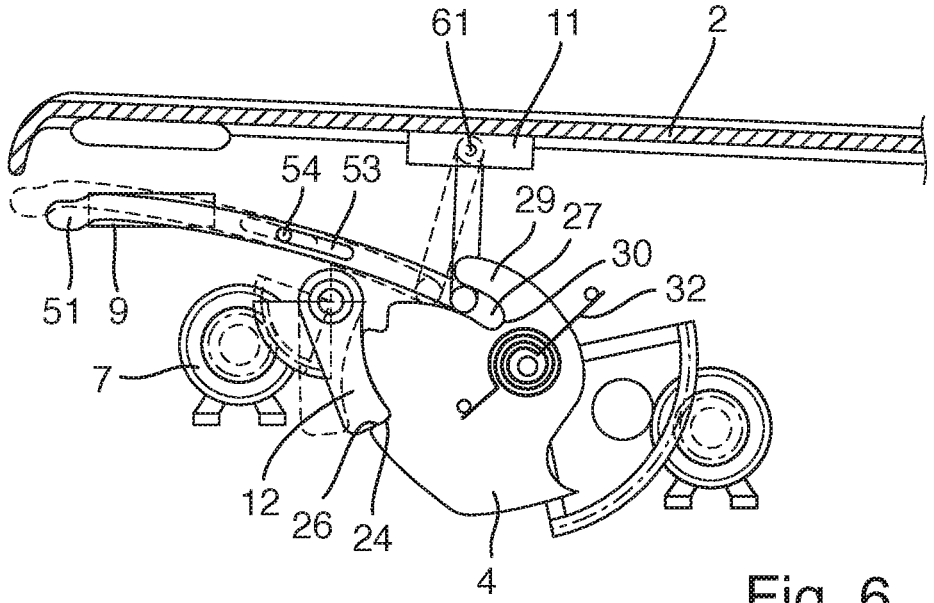
Figure 7:
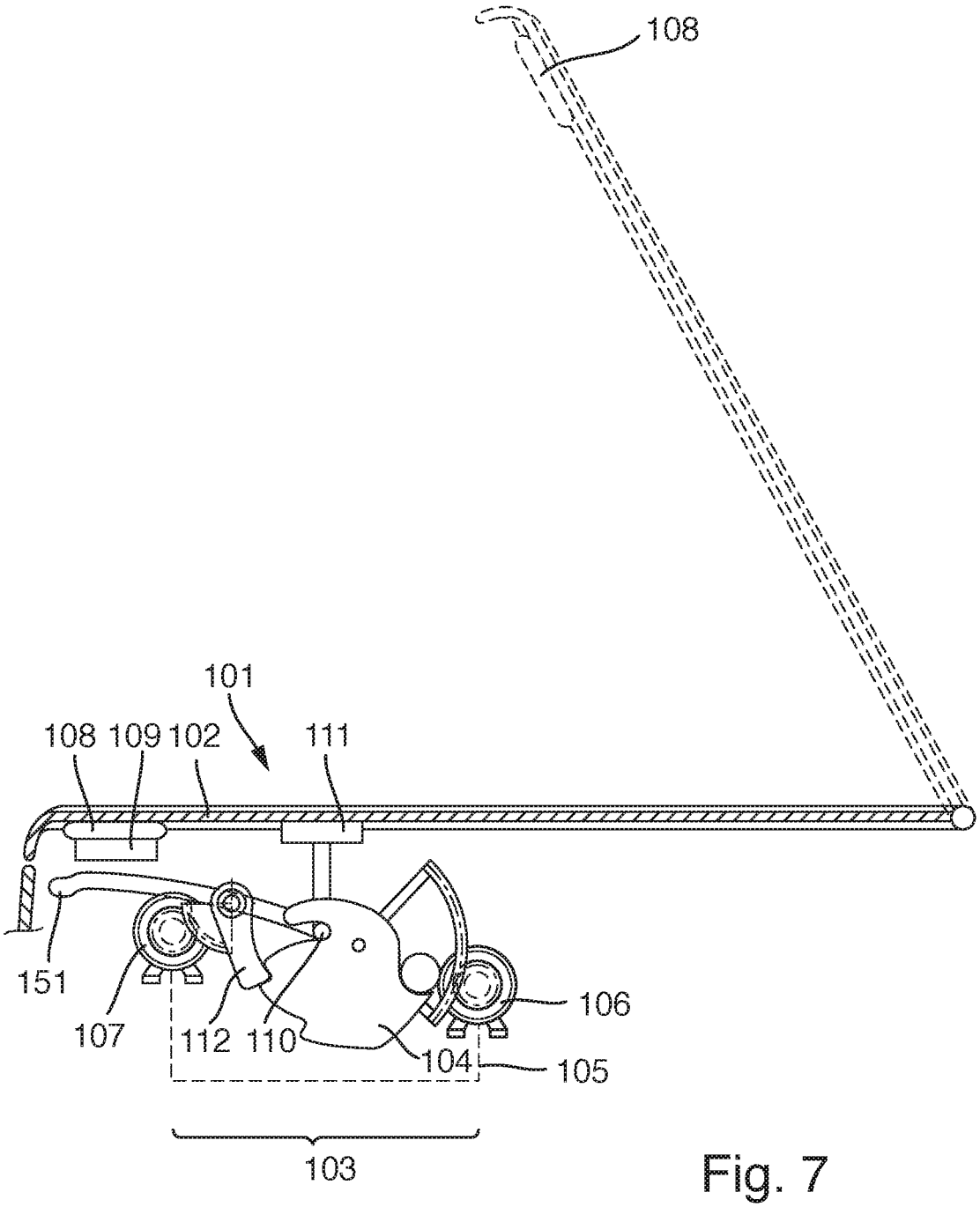
Figure 8:
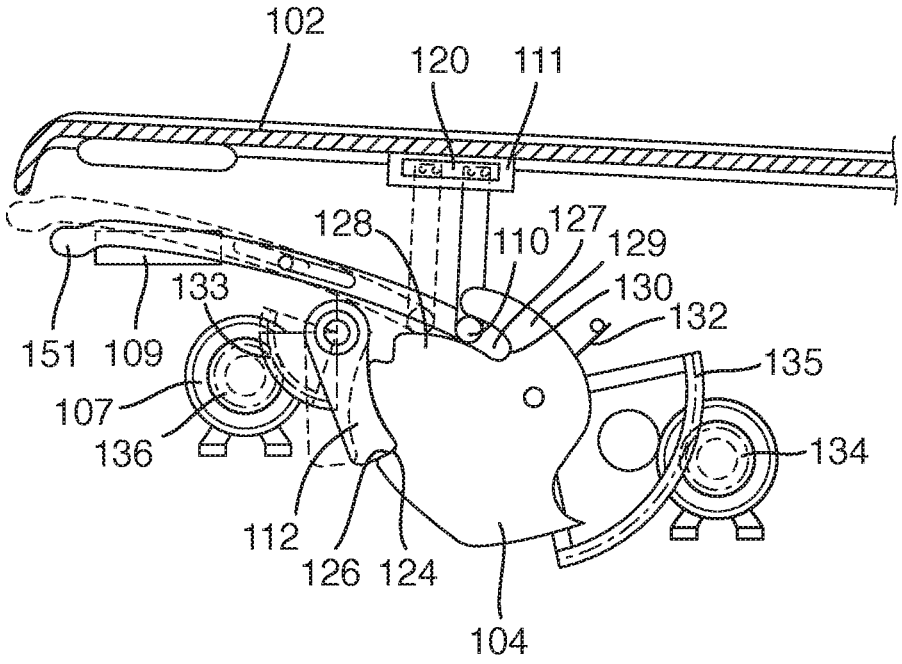

These show in:

FIG. 1 a sectional view of a safety device;

FIG. 2 a sectional view of a section of the safety device according to FIG. 1 with a catch in an opening end position;

FIG. 3 a sectional view of a section of the safety device according to FIG. 1 with the catch in a pre-ratchet position FIG. 4 a sectional view of a section of the safety device according to FIG. 1 with the catch in a main ratchet position;

FIG. 5 a sectional view of a section of the safety device according to FIG. 1 with a handle;

FIG. 6 a sectional view of a section of the safety device according to FIG. 1 with a pivotable latch holder;

FIG. 7 a sectional view of a further safety device;

FIG. 8 a sectional view of a section of the safety device according to FIG. 7 with a shiftable latch holder;

FIG. 1 shows a sectional view of a safety device 1 with a front hood 2, a hood latch 3 and a handle 51. The hood latch 3 has a catch 4 and an electrical drive 5 which comprises a first electromotor 6 and a second electromotor 7. The front hood 2 is closed in the position shown in FIG. 1 by means of solid lines, i.e. it is situated in a closure position. In the closure position, an elastic element 8, such as a sealing rubber which is arranged in the closure position between a static component 9 of the safety device 1 and the front hood 2 is compressed. The open position of the front hood 2 is illustrated in FIG. 1 in dot dashes. Furthermore, the safety device 1 has a latch holder 10 which is designed as a locking clip and is arranged on the front hood 2 by means of a coupling element 11. The catch 4 and a pawl 12 are respectively pivotably arranged on a non-illustrated component fixed to the chassis. The catch 4 is located in the main ratchet position shown in FIG. 1.

FIG. 2 shows a sectional view of a section of the safety device 1. The catch 4 has a rotational point 23, an opening rotational direction 21 and an opposite closure rotational direction 22 and is shown in an opening end position in FIG. 2. The catch is adjacent to a non-illustrated stop in the opening end position. Furthermore, the catch 4 has a pre-ratchet contour 24 and a main ratchet contour 25 respectively in the form of a protrusion and an infeed section 27 which is formed by a collecting arm 28 and a load arm 29. The pre-ratchet contour 24 and the main ratchet contour 25 can respectively interact with a counterratchet contour 26 of the pawl 12. The front hood 2 is located in the position shown in FIG. 2 in an intermediate position between the opening position and the closure position and is unbolted and released.

FIG. 3 shows a sectional view of a section of the safety device according to FIG. 1, whereby the catch 4 is located in a pre-ratchet position In the pre-ratchet position the pawl 12 is kept compressed with the aid of a pawl spring element 31, such as a tensioning, compression or spiral spring against the catch 4.

Advantageously, the catch 4 is acted on by a spring in the pre-ratchet position by means of a catch spring element 32, such as a tensioning, compression or spiral spring, in the opening rotational direction 21, whereby in the pre-ratchet position the pre-ratchet contour 24 is positioned in a pressing manner against the counterratchet contour 26.

Starting from the opening end position of the catch 4 shown in FIG. 2 during a movement of the front hood 2 in the direction of the closure position of the front hood 2 the latch holder 10 impacts the collecting arm 28 and is conducted by means of the collecting arm 28 in the direction of an internal end 30 of the infeed section 27, whereby the catch 4 rotates in the closure rotational direction 22. During rotation of the catch 4 in the closure rotational direction 22 until at least beyond the pre-ratchet position of the catch 4 the pre-ratchet contour 24 passes the counterratchet contour 26 and the pre-ratchet contour 24 is located viewed from the closure rotational direction 22 in front of the counterratchet contour 26, whereby the counterratchet contour 26 can ratchet into the pre-ratchet contour 24 and the catch 4 assumes the pre-ratchet position. In the pre-ratchet position the pawl 12 blocks a rotation of the catch 4 in an opening rotational direction 21, whereby the front hood 2 is bolted and blocked in the direction of the opening position, whereby the load arm 29 acts on the latch holder 10.

FIG. 4 shows a sectional view of a section of the safety device according to FIG. 1, whereby the catch 4 is located in the main ratchet position. The main ratchet position is attained by the catch 4 being rotated from the pre-ratchet position according to FIG. 3 further in the closure rotational direction 22. This can be caused in one embodiment by a depression of the front hood 2 and in another embodiment by an impulsion of the catch 4 by means of the first electromotor 6. A movement of the catch 4 in the direction of the main ratchet position can also be caused by a combination of manual depression and electrical impulsion of the first electromotor 6. Thus, for example, a torque can be transferred via an output socket gear 34 of the first electromotor 6 to a pinion gear drive 35 of the catch 4, whereby the torque is oriented in the closure rotational direction 22.

In an advantageous design, the first electromotor 6 is activated to impel the catch in the closure rotational direction as soon as a movement of the catch 4 is recorded in the closure rotational direction, for example by means of a sensor which can be executed as a multiturn potentiometer. A recording of the movement of the catch 4 in the closure rotational direction can furthermore be enabled by means of operation of the first electromotor 6 in generator operation, whereby rotation of the catch 4 in the closure rotational direction generates a current flow in the first electromotor 6.

During rotation of the catch 4 in the closure rotational direction 22 until at least beyond the main ratchet position of the catch 4 the main ratchet contour 25 passes the counterratchet contour 26 and the main ratchet contour 25 is located viewed from the closure rotational direction 22 in front of the counterratchet contour 26, whereby the counterratchet contour 26 can ratchet into the main ratchet contour 24 and the catch 4 then assumes the main ratchet position. FIG. 4 furthermore shows a circular brake block attached to the chassis to brake the catch 4 in the closure rotational direction, whereby in the main ratchet position play is present between the catch 4 and the brake block in order to enable a ratcheting of the catch into the main ratchet position.

In the main ratchet position the infeed section 30 encompasses the latch holder 10 and the pawl 12 blocks a rotation of the catch 4 in an opening rotational direction 21, whereby the front hood 2 is bolted, locked and blocked in the direction of the open position. The load arm 29 is preferably designed in such a way that in the main ratchet position of the catch 4 at least at a point of the infeed section 30 an area of the load arm 29 assumes an angle 41 of at least 10 degrees with an underside of the front hood 2. In the case of a frontal impact in which the catch 4 is shifted in the direction of travel compared to the front hood 2, this can cause increased pulling of the front hood 2 in the direction of the catch 4 and thus a firmer pressing of the front hood 2 onto a further chassis element, for example the static component 9, and thus reduce the risk of accidental unbolting of the front hood 2 and provide a more compact and thus crash-safe unit consisting of a front hood 2 and the further chassis element. This advantage is guaranteed by an arched infeed section 30 of the catch 4 and by the catch 4 as such as a component of the safety device 1.

After the counterratchet contour 26 is ratcheted into the main ratchet contour 24, the first electromotor 6 is deactivated where this was activated to switch from the pre-ratchet position into the main ratchet position. The first electromotor 6 can be operated to record the catch position in a generator mode in the short term, preferably operated intermittently between motor mode and generator mode, whereby in the generator mode a current signal is generated differently from zero where the catch has not yet reached the main ratchet position. After the catch has assumed the main ratchet position the catch rests and the current signal attains a zero value in generator mode. Such an operating mode of the first electromotor 6 enables dispensation with a sensor for recording of the catch position or to exact finetuning of the first electromotor 6 to the geometry of the catch 4.

Should the front hood 2 be unbolted starting from the main ratchet position, the catch 4 is initially transferred from the main ratchet position into the pre-ratchet position. This is caused in the exemplary embodiment shown in FIG. 1 to FIG. 4 by the second electromotor 7, by means of a pawl output socket gear 36 and a pawl pinion gear drive 33, moving the pawl 12 into the dot-dashed release position illustrated in FIG. 4 in which the catch 4 is released in the opening rotational direction.

Advantageously, the first electromotor 6 causes switching of the catch 4 from the main ratchet position shown in FIG. 4 into the pre-ratchet position shown in FIG. 3, whereby the safety device 1 has a mechanical operative connection during this switching. The mechanical operative connection is formed by the output socket gear 34 which is positively connected to the pinion shaft of the first electromotor 6 and the pinion gear drive 35 which is positively connected to the catch 4, whereby the output socket gear 34 combs with the pinion gear drive 35. In this switching of the catch 4 impelled by the first electromotor 6 as described above an intermittent operation of the first electromotor 6 is possible which alternates between motor mode and generator mode, whereby it is recordable when the catch 4 has reached the pre-ratchet position.

In a different embodiment, the catch 4 rotates in a spring-impinged manner by means of the catch spring element 32 from the main ratchet position into the pre-ratchet position after the pawl 12 has reached the release position. A further design can envisage an interactive impulsion of the catch 4 by means of the electromotor 6 and the catch spring element 32. The theory according to the invention does not inevitably envisage an electrical impulsion of the catch 4 or 104 during switching of the catch 4 or 104 from the main ratchet position into the pre-ratchet position. Consequently, an embodiment of the teaching according to the invention according to FIGS. 1 to 8 is also possible without the first electromotor 6 or 106. The switching of the catch 4 from the main ratchet position into the pre-ratchet position is caused in this case by the second electromotor 7 as described above.

FIG. 5 shows a sectional view of a section of the safety device 1 with a handle 51, which is kinematically connected to the latch holder 10. In the main ratchet position of the catch 4 in which the latch holder 10 and the front hood 2 assume the position illustrated in FIG. 5 by means of dot-dashed lines the handle 51 is manually inaccessible externally for an operator of the safety device 1. The handle 51 has a splitter slit 53 and is conducted in a splitter-controlled manner to a splitter pin 54 which is firmly arranged on the front hood 2 and clamps down on the splitter slit 53. During switching of the catch from the main ratchet position into the pre-ratchet position the collecting arm 28 moves the front hood 2 starting from the position shown in FIG. 5 with solid lines into the elevated position illustrated with dot-dashed lines. Advantageously, the first electromotor 6 assists this movement of the front hood 2 by means of a driving of the catch 4 whereby the load arm 28 elevates the front hood 2. In the elevated position an engagement area is formed for an operator of the safety device 1 between a front end 52 of the front hood 2 and the handle 51. The handle 51 is also elevated in the pre-ratchet position of the catch 4 in the same way as the front hood 2 and brought into an accessible position by provision of the engagement area which is illustrated in dot dashes in FIG. 5. On the end of the handle 51 facing the front end 52 of the front hood 2 the handle preferably has a knob.

FIG. 6 shows a sectional view of a section of the safety device 1, whereby the latch holder 10 is pivotably executed. In this embodiment, the coupling element 11 has a joint 61 which pivotably connects the latch holder 10 with the front hood 2. In FIG. 6 the closure position of the latch holder 10 is illustrated by means of solid lines in which the latch holder 10 can be manually moved by means of the handle 51. Starting from the closure position, the latch holder 10 can be manually transferred into the opening position by means of the handle 51 which is illustrated by means of dot-dashed lines. Especially advantageously, the latch holder 10 is spring-impinged in the direction of the internal end 30 of the infeed section 27. As shown in FIG. 6, in the closure position the latch holder 10 is adjacent on the load arm 29 of the catch 4, i.e. the latch holder 10 is engaged with the catch 4, whereby the front hood 2 cannot be moved in the direction of the open position of the front hood 2, i.e. is bolted. In the opening position of the latch holder 10 the latch holder 10 is released from the catch 4 and the front hood 2 can be moved in the direction of the open position, i.e. the front hood 2 is unbolted. During a movement of the latch holder 10 from the closure position to the opening position the front hood 2 can be slightly elevated dependent on a shape of the infeed section 27 which is not shown in FIG. 6 to retain an overview.

In order to transfer the catch 4 back into the opening end position shown in FIG. 2 the pawl 12 is operated so that the counterratchet contour 26 no longer interacts with the pre-ratchet contour 24. For example, the handle 51 can have a cam which works on a boom of the pawl during movement of the latch holder 10 from the closure position to the opening position by the handle 51 and the counterratchet contour moves out of the pre-ratchet contour, whereby a rotation of the catch 4 is released in an opening rotational direction 21. It is also possible that a sensor in the pre-ratchet position of the catch 4 records the position of the front hood 2 and, as soon as the front hood 2 performs a movement from the closure position to the opening position releases an unlocking signal to a control device. As soon as the control device receives the unlocking signal the second electromotor 7 can be operated by means of the control device and impel the pawl 12 and move into the release position illustrated in dot dashes. The catch 4 is then released in the opening rotational direction 21. Subsequently, the catch 4 is impelled in a spring-impinged manner via the catch spring element 32 in the direction of the opening rotational direction 21 and moves into the opening end position in which the latch holder can be collected by means of the collecting arm 28 in the case of a closure movement of the front hood 2.

FIG. 7 shows a sectional view of a further safety device 101 with a front hood 102, a hood latch 103 and a handle 151. The hood latch 103 has a pawl 104 and an electrical drive 105 which has a first electromotor 106 and a second electromotor 107. The front hood 102 is closed in the position shown in FIG. 7, i.e. it is situated in the closure position. In the closure position, an elastic element 108, such as a sealing rubber which is arranged in the closure position between a static component 109 of the safety device 101 and the front hood 102 is compressed. The open position of the front hood 102 is illustrated in FIG. 1 in dot dashes. Furthermore, the safety device 101 has a latch holder 110 which is designed as a locking clip, for example, and is arranged on the front hood 102 by means of a coupling element 111. The catch 104 and a pawl 112 are respectively arranged on a non-illustrated component fixed to the chassis. The catch 104 is located in the main ratchet position shown in FIG. 7. All components of the safety device 101 shown in FIG. 7 are identical to the components of the safety device 1 shown in FIG. 1 and have the same functionality as the components of the safety device 1 shown in FIG. 1 with the exception of the coupling element 111 and the latch holder 110. Furthermore, the safety device 101 has the same functionality as described in FIGS. 1, 2, 3, 4 and 5 for the safety device 1 and furthermore possesses these same components described in FIGS. 1, 2, 3, 4 and 5 for the safety device 1, with the exception of the coupling element 111 and the latch holder 110.

FIG. 8 shows a sectional view of a section of the safety device 101, whereby the latch holder 110 is shiftably executed. In this embodiment, the coupling element 111 has a guide rail 120 which the latch holder 110 glides along on transfer from the closure position to the opening position.

In FIG. 8, the closure position of the latch holder 110 is illustrated by means of dot-dashed lines in which the latch holder 110 can be manually moved by means of the handle 151. Starting from the closure position, the latch holder 110 can be manually transferred into the opening position which is illustrated by means of dot-dashed lines by means of the handle 151. Especially advantageously, the latch holder 110 is spring-impinged in the direction of an internal end 130 of an infeed section 127 of the catch 104. As shown in FIG. 8, in the closure position the latch holder 110 is adjacent on the load arm 129 of the catch 104, i.e. the latch holder 110 is engaged with the catch 104, whereby the front hood 102 cannot be moved in the direction of the open position of the front hood 102, i.e. is bolted. In the opening position of the latch holder 110 the latch holder 110 is released from the catch 104 and the front hood 102 can be moved in the direction of the open position, i.e. the front hood 102 is unbolted. During a movement of the latch holder 110 from the closure position to the opening position the front hood 102 can be slightly elevated dependent on a form of the infeed section 127 which is not shown in FIG. 8 to retain an overview. In particular, the latch holder 110 is executed as a rigid component and has a constant length, width and height during transfer from the closure position to the opening position.

The invention claimed is:

1. A safety device for a front hood of a motor vehicle, the safety device comprising:

a hood latch having a latch holder that is arranged on the front hood and movable between an opening position in which the front hood is opened and a closure position in which the front hood is bolted, respectively, and a catch that is movable between a pre-ratchet position and a main ratchet position in which the catch is directly engageable with the latch holder in the closure position, an electrical drive which includes an electromotor that causes switching of the catch from the main ratchet position into the pre-ratchet position, wherein when the catch is in the pre-ratchet position, the latch holder is in an intermediate position between the closure position in which the front hood is bolted and the opening position, in which the latch holder is released from direct engagement with the catch and the front hood is unbolted and manually movable, and a handle directly attached to the latch holder which enables manual operation of the latch holder to the opening position when the catch is in the pre-ratchet position, wherein an entire opening operation of the front hood is constituted by an initial electrical opening operation performed by only the electrical drive in which the electrical drive switches the catch into the pre-ratchet position without a manual operation, and a subsequent manual opening operation that occurs independently from the initial electrical opening operation and without operation of the electrical drive after the electrical drive switches the catch into the pre-ratchet position, wherein the electrical drive includes a gear that is engageable with the catch for moving the catch to the main ratchet position.

2. The safety device according to claim 1, wherein the safety device, during switching of the catch from the main ratchet position to the pre-ratchet position, has a mechanical operative connection between the electrical drive and the catch.

3. The safety device according to claim 1, wherein the safety device, during switching of the catch from the pre-ratchet position to the main ratchet position, has a mechanical operative connection between the electrical drive and the catch.

4. The safety device according to claim 1, wherein the latch holder is pivotably executed.

5. The safety device according to claim 1, wherein the latch holder is shifted in a direction of a lengthwise extension of the front hood.

6. The safety device according to claim 1, wherein the handle is transferred into an accessible operating position during switching of the catch from the main ratchet position to the pre-ratchet position.

7. The safety device according to claim 1, wherein the latch holder is a locking clip arranged on the front hood by a coupling element.

8. The safety device according to claim 1 further comprising a pawl that is engageable between the electrical drive and the catch, wherein the catch has a pre-ratchet contour in which the pawl engages when the catch is in the pre-ratchet position, and a main ratchet contour in which the pawl engages when the catch is in the main ratchet position.

9. The safety device according to claim 8, wherein the pre-ratchet contour and the main ratchet contour are formed adjacent an infeed section formed in the catch that receives the latch holder.

10. The safety device according to claim 1, wherein the gear of the electrical drive includes an output socket gear that is engageable with a pinion gear drive of the catch for moving the catch to the main ratchet position.

11. The safety device according to claim 1 further comprising a pawl engageable with the catch, wherein the electromotor of the electrical drive includes a first electromotor having an output socket gear that is engageable with a pinion gear drive of the catch, and a second electromotor having a pawl output socket gear that is engageable with a pawl pinion gear drive of the pawl.

12. The safety device according to claim 1, wherein the handle has a splitter slit.

13. The safety device according to claim 1, wherein the handle has a knob on an end of the handle opposite to where the handle is attached to the latch holder.

14. The safety device according to claim 1, wherein the handle is configured to pivot the latch holder from the closure position to the opening position.

15. The safety device according to claim 1, wherein the handle is configured to shift the latch holder from the closure position to the opening position.

16. A safety device for a front hood of a motor vehicle, the safety device comprising:

a hood latch having a latch holder that is arranged on the front hood and movable between an opening position in which the front hood is opened and a closure position in which the front hood is bolted, respectively, and a catch that is movable between a pre-ratchet position and a main ratchet position in which the catch is directly engageable with the latch holder in the closure position, an electrical drive which causes switching of the catch from the main ratchet position into the pre-ratchet position, wherein when the catch is in the pre-ratchet position, the latch holder is in an intermediate position between the closure position in which the front hood is bolted and the opening position, in which the latch holder is released from direct engagement with the catch and the front hood is unbolted and manually movable, a handle directly attached to the latch holder which enables manual operation of the latch holder from the closure position to the opening position when the catch is in the pre-ratchet position, and a pawl engageable with the catch, wherein the electrical drive includes a first electromotor having an output socket gear that is engageable with a pinion gear drive of the catch, and a second electromotor having a pawl output socket gear that is engageable with a pawl pinion gear drive of the pawl.

17. A safety device for a front hood of a motor vehicle, the safety device comprising:

a hood latch having a latch holder that is arranged on the front hood and movable between an opening position in which the front hood is opened and a closure position in which the front hood is bolted, respectively, and a catch that is movable between a pre-ratchet position and a main ratchet position in which the catch is directly engageable with the latch holder in the closure position, an electrical drive which causes switching of the catch from the main ratchet position into the pre-ratchet position, wherein when the catch is in the pre-ratchet position, the latch holder is in an intermediate position between the closure position in which the front hood is bolted and the opening position, in which the latch holder is released from direct engagement with the catch and the front hood is unbolted and manually movable, a handle directly attached to the latch holder which enables manual operation of the latch holder from the closure position to the opening position when the catch is in the pre-ratchet position, and a pawl engageable with the catch, wherein the electrical drive includes a first electromotor having an output gear that is engageable with a gear drive of the catch, and a second electromotor having a pawl output gear that is engageable with a gear drive of the pawl.

* * * * *